United States Patent [19]

Tohmata et al.

[11] Patent Number: 4,585,564

[45] Date of Patent: Apr. 29, 1986

[54] COLD ROLLING OIL FOR STEEL SHEET

[75] Inventors: Eisuke Tohmata; Ryoichiro Takahashi; Sakae Sonoda; Shoji Okamoto, all of Yokohama; Osamu Furuyama, Ichikawa, all of Japan

[73] Assignee: Nippon Kokan Kabushiki Kaisha, Japan

[21] Appl. No.: 620,876

[22] Filed: Jun. 15, 1984

[30] Foreign Application Priority Data

Jun. 17, 1983 [JP] Japan ..... 58-108932

[51] Int. Cl.[4] ..... C10M 141/02

[52] U.S. Cl. ..... 252/32.5; 252/49.5; 252/49.6; 252/52 A; 252/56 R; 252/51; 252/51.5 A; 72/42

[58] Field of Search ..... 252/49.5, 49.6, 52 A, 252/56 R, 51.5 A, 51, 32.5

[56] References Cited

U.S. PATENT DOCUMENTS 4,390,438 6/1983 Kennedy et al. ..... 252/49.5

4,392,865 7/1983 Grosse et al. ..... 252/49.5

*Primary Examiner*—Jacqueline V. Howard

*Attorney, Agent, or Firm*—Ostrolenk, Faber, Gerb & Soffen

[57] ABSTRACT

In this invention provided are cold rolling oils for steel sheets which are applied for cold rolling of steel sheets and have excellent lubricity, lubrication stability, and fresh oil replenishing property.

12 Claims, 3 Drawing Figures

COLD ROLLING OIL FOR STEEL SHEET

BACKGROUND OF THE INVENTION (1) Field of the Invention

This invention relates to cold rolling oils (hereinafter referred to simply as "rolling oil") for steel sheets which are applied for cold rolling of steel sheets and have excellent lubricity, lubrication stability, and fresh oil replenishing property.

(2) Description of the Prior Art

Rolling oils are prepared by adding various emulsifying and dispersing agents to mixtures obtained by adding oiliness improvers, extreme-pressure additives, antioxidants and the like to animal or vegetable oils such as tallow, palm oil and the like, various synthetic esters, mineral oils, or the mixed oils thereof. In rolling, a liquid obtained by emulsifying and dispersing a rolling oil in a suitable concentration (hereinafter referred to "coolant liquid") by means of mechanical agitation in a tank (hereinafter referred to "coolant tank") is sprayed on work rolls for cooling and the surface of steel sheets for lubricating oil, and is circulated.

For the sake of elevating productivity, it is recently intended to perform high-speed rolling and continuous manufacturing of steel sheets. In this respect, it is required that rolling oil has excellent lubricity, and particularly stability of lubrication.

Lubricity and stability in lubrication are affected by composition of a rolling oil, and they are also influenced significantly by extent of and changes in amount of adhesion to the steel sheet (plate-out). More specifically, a less amount of plate-out brings about insufficient lubrication, whilst it causes variation of lubrication even though there is much more amount of plate-out, if there is a variation in such amount so that it results in a lack in uniformity. Accordingly it is preferred for favorable lubricity and stability in lubrication that such amount of plate-out is remarkable and in addition, uniform. Furthermore the amount of plate-out is significantly related to particle size of rolling oil in a coolant liquid to be sprayed (the amount of plate-out becomes small in case of small particle size), so that lubricity is dependent upon particle size of the rolling oil. Such particle size is easily influenced by stirring conditions. In this connection, since a coolant liquid passes through pumps, nozzles and return lines by means of circulation in addition to agitation of the coolant liquid in coolant tanks in case of rolling, the stirring conditions vary. Even under such conditions as mentioned above, it is desired that particle size of the rolling oil is uniform and stable.

Nonionic or anionic emulsifying and dispersing agents have heretofore been employed for rolling oils. On one hand, rolling oil particles exhibit a particle size distribution of wide range extending from 2 to 40 microns, because of formation of finer particles due to agitation and formation of larger particles due to coagulation. Owing to such non-uniformity, the plate-out amount becomes also non-uniform so that lubricity varies easily.

As a result of various studies, such problem could be solved by using a cationic high-molecular compound as emulsifying and dispersing agent. Cationic high molecular compounds have heretofore been utilized for organic substances as coagulant and dispersion stabilizers. It is known that a slight amount of cationic high-molecular compound exhibits a coagulating effect, whilst strong dispersion stabilizing effect is observed in the case when a comparatively large amount of cationic high-molecular compound is employed. This is because an organic substance is negatively charged by means of agitation so that the organic substance charged is electrically adsorbed on cationic high-molecular compound strongly. Further, in the case where a slight amount of cationic high-molecular compound is used, the surface potential of particle is neutralized so that such cationic high-molecular compound exhibits coagulating effect. On the other hand, when a large amount of such cationic high-molecular compound is utilized, the high-molecular compound covers the particles to give positive surface potential thereto so that coagulation is prevented by the resulting electric repulsion effect as well as the steric hindrance effect of the macromolecule, and it exhibits dispersion stability.

When a cationic high-molecular compound is used for rolling oil as the emulsifying and dispersing agent, since such high-molecular compound has excellent coagulation resistance, particles formed in case of vigorous agitation are not coagulated and exit stably, even if agitation force becomes weaker. Furthermore, since the emulsifying and dispersing agent is a high-molecular compound, such compound includes a plurality of fine particles so that comparatively large particles exist. As a result, particle size distribution is narrow and sharp. In this case, particle size can be controlled by structure and molecular weight of a cationic high-molecular compound to be used.

However, cationic high-molecular compound scarcely reduces interfacial tension, although such compound is excellent in emulsion and dispersion stability. For this reason, a cationic high-molecular compound is unfavorable in initial emulsifying and dispersing property so that higher energy than that in conventional cases is required for emulsification and dispersion. Thus, such cationic high-molecular compound does not emulsify and disperse rolling oil in the coolant liquid easily at the time of replenishment thereof so that target concentration is not obtained. As a result, more rolling oil than it requires is replenished, and then such problem that cost of rolling oil becomes high arises. In addition, such trouble that lubricity varies arises, because such oil which has not been emulsified and dispersed, but has floated is involved non-uniformly in the circulating system.

SUMMARY OF THE INVENTION

It is an object of the present invention to provide cold rolling oils for steel sheets which can comply with speeding-up of rolling as well as continuation of steel sheet production and by which advantages of the addition of the cationic high-molecular compounds as described above can be obtained and its disadvantages can be eliminated.

DESCRIPTION OF THE PREFERRED EMBODIMENTS

Figure 1:
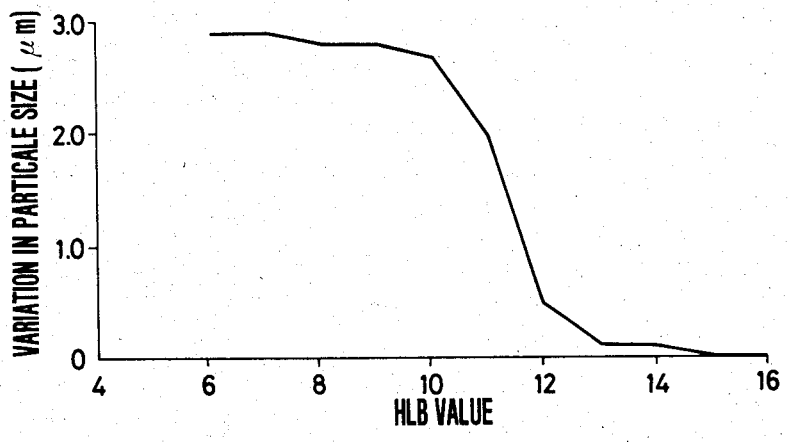
FIG. 1 is a graph indicating effect of HLB value of a nonionic surfactant on emulsifying and dispersing property.

In the present invention made for attaining the above object, it has been found advantageous to add a nonionic surfactant to rolling oil as a component. More specifically, initial emulsifying and dispersing property of rolling oil in coolant liquid is extremely enhanced by adding such nonionic surfactant to the rolling oil, and on the other hand, the emulsion dispersion stability of rolling oil in coolant liquid is extremely enhanced by adding a cationic high-molecular compound to the rolling oil. In order to not inhibit emulsion and dispersion stability, the nonionic surfactant to be added has a 12 or more HLB value by Atlas method and an addition amount of which ranges 0.1–5%, and preferably 0.3–3%. If HLB value is lower than 12, effects of cationic high-molecular compounds are hindered. Furthermore if addition of such nonionic surfactant is less than 0.1%, no effect is observed, whilst more than 5% of addition prevents the effects of the cationic high-molecular compound added.

Nonionic surfactant involves hydrophilic groups and lipophilic groups, and HLB value is balance of the hydrophilic groups and the lipophilic groups expressed numerically. The higher HLB value brings in the higher weight ratio of hydrophilic groups. In the present invention, HLB value was calculated in accordance with Atlas method. A nonionic surfactant decreases interfacial tension and broadens the interface in even weak agitation, so that it makes the initial emulsifying and dispersing property better. However, since nonionic surfactant exists in the interface of rolling oil particle and water, such nonionic surfactant which is strongly adsorbed on the rolling oil particle inhibits adsorption of cationic high-molecular compound on the rolling oil particle. The stronger lipophilic nature, i.e., the smaller HLB value of a nonionic surfactant results in the stronger adsorption on rolling oil particles so that extent of the inhibition becomes remarkable. When the lipophilic nature weakens to exhibit 12 or more of HLB value, the nonionic surfactant presents initial emulsifying and dispersing property in the coolant liquid, then the surfactant separates from rolling oil particles because its adsorptivity on the rolling oil particles is weak, and as a result, a cationic high-molecular compound adsorbs easily on the rolling oil particles so that the nonionic surfactant inhibits scarcely the advantageous effects of the cationic high-molecular compound. There is, however, a concentration effect and when the addition of the nonionic surfactant exceeds 5%, it inhibits advantageous effects of the cationic high-molecular compound.

Effect of the addition of a nonionic surfactant to rolling oil on initial emulsifying and dispersing property will be shown in Table 1.

TABLE 1

| Addition Amount of Nonionic Surfactant (%) | 0 | 0.1 | 0.2 | 0.3 | 0.5 | 1 | 3 | 5 |
|---|---|---|---|---|---|---|---|---|
| Initial Emulsifying and Dispersing Property | x | | | | | | | |

(Note)

| | |
|---|---|
| Composition of the rolling oil employed | |
| Basic Oil (Material to be emulsified): | Tallow |
| Nonionic Surfactant: | polyoxyethylene sorbitan monooleate (EO: 20 mol HLB value: 15.0) |
| Evaluation of Initial Emulsifying and Dispersing Property: | Very Good<br>x Poor |

Effect of HLB value of a nonionic surfactant on emulsifying and dispersing property is indicated in FIG. 1 wherein composition of the oil under test is as follows.

| | |
|---|---|
| Tallow: | 98% |
| Cationic High-molecular Compound: | 1% |
| Nonionic Surfactant: | 1% |
| | 100% |

As is apparent from FIG. 1, favorable results are obtained when the HLB value is 12 or more.

Figure 2:
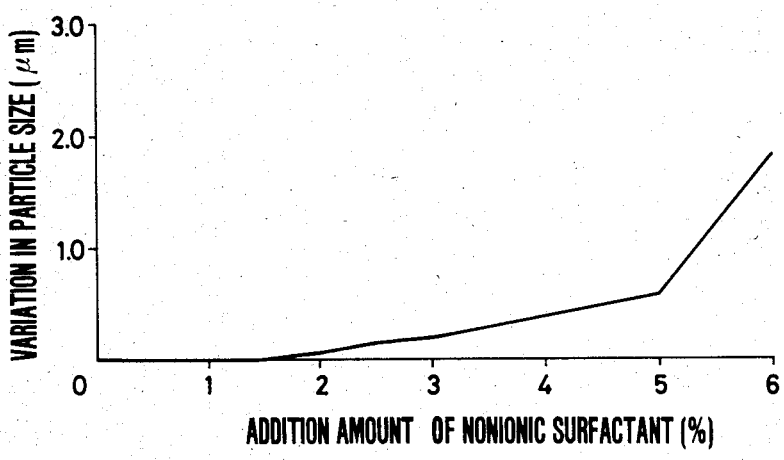
FIG. 2 is a graph indicating effect of the addition of a nonionic surfactant on emulsion and dispersion stability.

Effect of the addition of a nonionic surfactant on emulsion and dispersion stability is indicated in FIG. 2 wherein composition of the oil under test is as follows.

| | |
|---|---|
| Tallow: | Remaining % |
| Cationic High-molecular Compound: | 1% |
| Nonionic Surfactant: | x% |
| | 100% |

[As a nonionic surfactant, polyoxyethylene sorbitan monooleate (EO: 20 mol, HBL: 15.0), x%=0−6% is used.]

As is clear from FIG. 2, favorable results are obtained when the addition of the nonionic surfactant is 5% or less.

Variation in particle size appeared in FIGS. 1 and 2 is determined by the following equation.

$$\text{Variation in particle size } (\mu m) = A - B$$

wherein

A: average particle size in case of stirring at 10,000 rpm for 30 min. by means of homomixer, B: average particle size in case of further stirring at 5,000 rpm for 30 min. by means of homomixer.

In this case, the smaller variation in particle size exhibits the more favorable emulsion and dispersion stability. Further the above test was carried out in a concentration of 3% and a temperature of 60° C. Acetic acid salt of N, N-dimethylaminoethyl methacrylate (average molecular weight $7\times10^4$) was employed as the cationic high-molecular compound.

The nonionic surfactants used in the present invention include polyoxyethylene alkylethers, polyoxyethylene alkylphenylethers, polyoxyethylene alkylesters, polyoxyethylene sorbitan alkylesters and the like and each having 12 or more HLB value by Atlas method.

On one hand, the cationic high-molecular compounds of the invention include salts of organic acid such as formic, acetic, propionic or the like acid of, or inorganic acid such as phosphoric, boric or the like acid of N, N-dialkylaminoalkyl polymethacrylates (or polyacrylates) N, N-dialkylaminoalkyl polymethacrylamides (or polyacrylamides), polyaminesulfones, polyethyleneimines, polyacrylic acids (or polymethacrylic acids), hydrazides, and α-N,N-dimethylaminopoly-ε-capramides and the like.

In order to make clear the advantages of the present invention, examples of the invention will be described hereinbelow together with comparative examples.

EXAMPLES

Figure 3:
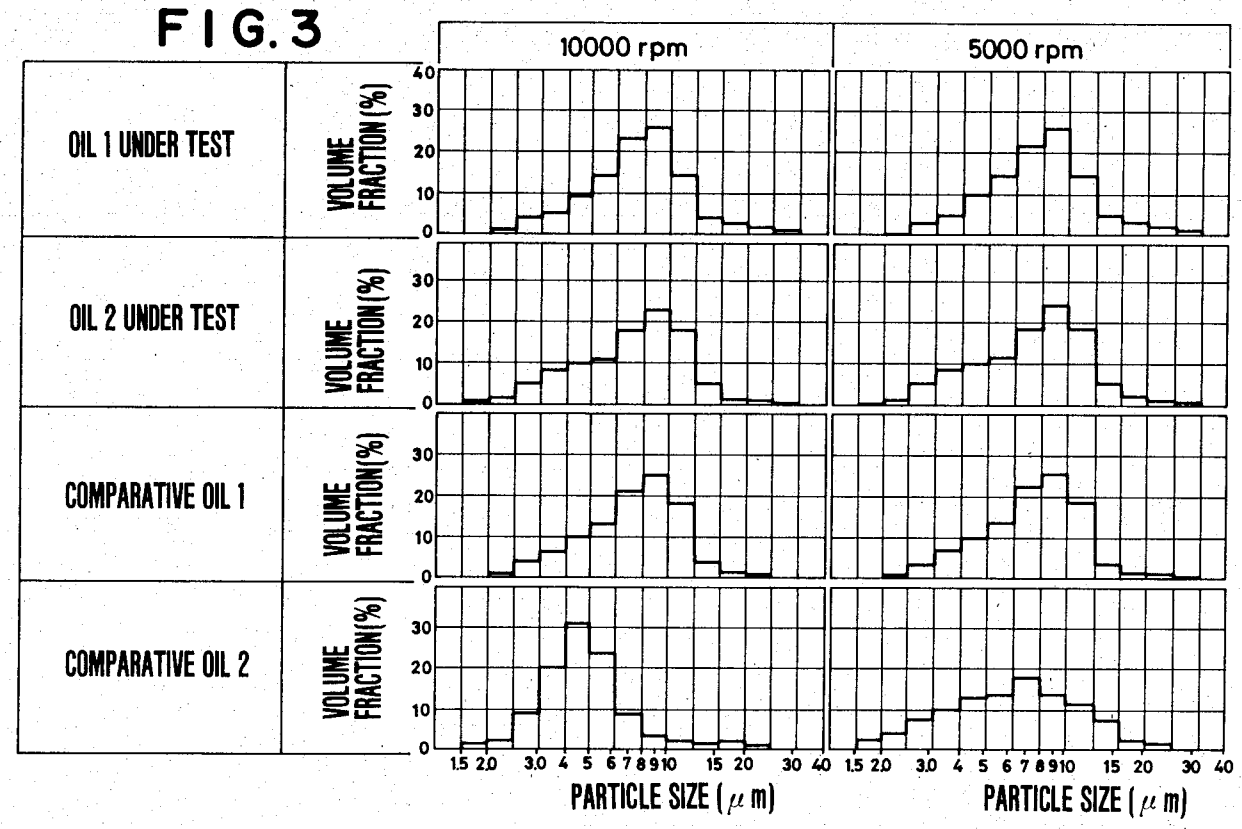
FIG. 3 is a graph indicating each particle size distribution in respect of oils under test as well as comparative oils.

Initial emulsifying and dispersing property was observed (the result is shown in Table 2) on the basis of visual evaluation by means of de-emulsifying tester (agitation: 1500 rpm) with use of each oil under test (10% concentration, 60° C. temperature) as mentioned hereinafter. Furthermore emulsion and dispersion stability was observed by measuring of particle size distribution and average particle size in respect of rolling oil particles after stirring an oil under test having 3% concentration and 60° C. temperature at 10,000 rpm for 30 min. by means of homomixer as well as particle size distribution and average particle size of the rolling oil particles after further stirring the oil under test at much lower 5,000 rpm for another 30 min. by utilizing coulter counter. Results as to the average particle size and the particle size distribution in the above measurement are shown in Table 2 and FIG. 3, respectively. The same measurement was effected upon each comparative oil and the results thereof are also shown in Table 2 and FIG. 3, respectively.

| | |
|---|---|
| <Oil 1 under Test> | |
| *Tallow | 98 parts |
| *Polyoxyethylene sorbitan monooleate (EO: 20 mol, HLB value: 15.0) | 1 part |
| *Acetic acid salt of N, N—dimethylaminoethyl polymethacrylate (average molecular weight: $7 \times 10^4$) | 1 part |
| <Oil 2 under Test> | |
| *Tallow | 98 part |
| *Polyoxyethylene stearate (EO: 30 mol, HLB value: 16.0) | 1 part |
| *Acetic acid salt of N, N—dimethylaminoethyl polymethacrylate (average molecular weight: $7 \times 10^4$) | 1 part |
| <Comparative Oil 1> | |
| *Tallow | 99 parts |
| *Acetic acid salt of N, N—dimethylaminoethyl polymethacrylate (average molecular weight: $7 \times 10^4$) | 1 part |
| <Comparative Oil 2> | |
| *Tallow | 98 parts |
| *Polyoxyethylene sorbitan trioleate (EO: 20 mol, HLB value: 11.0) | 1 part |
| *Acetic acid salt of N, N—dimethylaminoethyl polymethacrylate (average molecular weight: $7 \times 10^4$) | 1 part |

TABLE 2

| | Initial Emulsifying and Dispersing Property | Emulsion & Dispersion Stability: Average Particle Size (μm) at 10,000 rpm | Emulsion & Dispersion Stability: Average Particle Size (μm) at 5,000 rpm |
|---|---|---|---|
| Oil 1 under Test | | 7.8 | 7.8 |
| Oil 2 under Test | | 7.7 | 7.9 |
| Comparative Oil 1 | x | 7.9 | 7.9 |
| Comparative Oil 2 | | 4.7 | 6.7 |

As is apparent from the above Table 3, it can be appreciated that both the oils 1 and 2 under test are excellent in initial emulsifying and dispersing property and emulsion and dispersion stability, whilst comparative oil 1 is excellent in emulsion and dispersion stability, but poor in initial emulsifying and dispersing property and comparative oil 2 is excellent in initial emulsifying and dispersing property, but poor in emulsion and dispersion stability.

While the examples wherein tallow is used as the base oil have been described above, the invention is not limited thereto and, of course, such modification wherein various rolling oils involving mixed oils or oiliness improvers and the like are utilized may be contained in the present invention.

As described above, since the cold rolling oil for steel sheets according to the present invention contains a cationic high-molecular compound and a nonionic surfactant having an HLB value of 12 or more as the emulsifying and dispersing agents, such excellent advantages that the rolling oil particles become comparatively large, its initial emulsifying and dispersing property and emulsion and dispersion stability are excellent, as a result, its lubricity and lubrication stability become excellent, and it makes high-speed rolling and continuous manufacturing of steel sheets possible, whereby the productivity thereof can be elevated.

What is claimed is:

1. A cold rolling oil composition for steel sheets consisting essentially of (1) cold rolling oil and (2) cationic high-molecular compound and 0.1–5% of nonionic surfactant having an HLB value of at least 12 as emulsifying and dispersing agents.

2. A cold rolling oil for steel sheets as claimed in claim 1 wherein said nonionic surfactant is selected from the group consisting of polyoxyethylene alkylether, polyoxyethylene alkylphenylether, polyoxyethylene alkylester, and polyoxyethylene sorbitan alkylester.

3. A cold rolling oil for steel sheets as claimed in claim 1 wherein said cationic high-molecular compound is selected from the group consisting of salts or organic acid or inorganic acid.

4. A cold rolling oil for steel sheets as claimed in claim 1 wherein said rolling oil is an oil prepared from at least one, material selected from the group consisting of animal oils, vegetable oils, synthetic esters, and mineral oils.

5. A cold rolling oil for steel sheets as claimed in claim 1 wherein said rolling oil contains at least one, additive selected from the group consisting of oiliness improvers, extreme-pressure additives, and antioxidants.

6. A cold rolling oil for steel sheets as claimed in claim 1 wherein the amount of nonionic surfactant is 0.3–3%.

7. A cold rolling oil for steel sheets as claimed in claim 2 wherein the amount of nonionic surfactant is 0.3–3%.

8. A cold rolling oil for steel sheets as claimed in claim 2 wherein said cationic high-molecular compound is selected from the group consisting of salts of organic acid or inorganic acid and said rolling oil is an oil prepared from at least one material selected from the group consisting of animal oils, vegetable oils, synthetic esters and mineral oils.

9. A cold rolling oil for steel sheets as claimed in claim 8 wherein the amount of nonionic surfactant is 0.3–3%.

10. A cold rolling oil for steel sheets as claimed in claim 9 wherein said cationic high-molecular compound is a formic, acetic, propionic, phosphoric or boric acid salt of N,N-dialkylaminoalkyl polymethacrylate or polyacrylate or N,N-dialkylaminoalkyl polymethacrylamide or polyacrylamide, polyaminesulfone, polyethyleneimine, polyacrylic acid, polymethacrylic acid, hydrazide or α-N,N-dimethylaminopoly-ε-capramide.

11. A cold rolling oil for steel sheets as claimed in claim 10 wherein said rolling oil is an oil prepared from tallow and wherein said nonionic surfactant is polyoxyethylene sorbitan monooleate or polyoxyethylene stereate.

12. A cold rolling oil for steel sheets as claimed in claim 11 wherein said high-molecular compound is acetic acid salt of N,N-dimethylaminoethyl polymethacrylate.

* * * * *

UNITED STATES PATENT AND TRADEMARK OFFICE

CERTIFICATE OF CORRECTION

PATENT NO. : 4,585,564

DATED : April 29, 1986

INVENTOR(S) : Eisuke Tohmata, Ryoichiro Takahashi, Sakae Sonoda, Shoji Okamoto and Osamu Furuyama It is certified that error appears in the above-identified patent and that said Letters Patent is hereby corrected as shown below:

In the headings after "[73] Assignee:" read --Nippon Kokan Kabushiki Kaisha and Nihon Parkerizing Co., Ltd., Japan.

Column 6, line 38, for "or" read --of--.

Signed and Sealed this

Thirteenth Day of January, 1987

*Attest:*

DONALD J. QUIGG

*Attesting Officer*

*Commissioner of Patents and Trademarks*